US008044873B2

(12) United States Patent
Chiang et al.

(10) Patent No.: US 8,044,873 B2
(45) Date of Patent: Oct. 25, 2011

(54) ANTENNAS WITH PERIODIC SHUNT INDUCTORS

(75) Inventors: Bing Chiang, Cupertino, CA (US); Gregory Allen Springer, Sunnyvale, CA (US); Douglas B. Kough, San Jose, CA (US); Enrique Ayala, Watsonville, CA (US); Matthew Ian McDonald, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 12/759,598

(22) Filed: Apr. 13, 2010

(65) Prior Publication Data

US 2010/0194653 A1 Aug. 5, 2010

Related U.S. Application Data

(63) Continuation of application No. 11/958,824, filed on Dec. 18, 2007, now Pat. No. 7,705,795.

(51) Int. Cl.
*H01Q 13/10* (2006.01)

(52) U.S. Cl. ..... 343/768; 343/772; 343/857

(58) Field of Classification Search ..... 343/743, 343/746, 749, 750, 767, 768, 769, 772, 857, 343/700 MS See application file for complete search history.

(56) References Cited

U.S. PATENT DOCUMENTS

| | | | |
|---|---|---|---|
| 5,955,995 | A | 9/1999 | Silverstein |
| 6,285,333 | B1 | 9/2001 | Reed et al. |
| 6,369,771 | B1 | 4/2002 | Chiang et al. |
| 6,670,923 | B1 | 12/2003 | Kadambi et al. |
| 6,741,214 | B1 | 5/2004 | Kadambi et al. |
| 6,747,601 | B2 | 6/2004 | Boyle |
| 6,774,852 | B2 | 8/2004 | Chiang et al. |
| 6,856,294 | B2 | 2/2005 | Kadambi et al. |
| 6,888,510 | B2 | 5/2005 | Jo et al. |
| 6,980,154 | B2 | 12/2005 | Vance et al. |
| 7,027,838 | B2 | 4/2006 | Zhou et al. |
| 7,116,276 | B2 | 10/2006 | Lee |
| 7,119,747 | B2 | 10/2006 | Lin et al. |
| 7,123,200 | B1 | 10/2006 | Smith et al. |
| 7,123,208 | B2 | 10/2006 | Baliarda et al. |
| 7,176,842 | B2 | 2/2007 | Bettner et al. |
| 7,187,337 | B2 | 3/2007 | Aikawa et al. |

(Continued)

FOREIGN PATENT DOCUMENTS

| | | |
|---|---|---|
| JP | 08242118 | 9/1996 |
| WO | 03/058758 | 7/2003 |
| WO | 2007/000749 | 1/2007 |

OTHER PUBLICATIONS

Hill et al. U.S. Appl. No. 11/650,187, filed Jan. 4, 2007.

(Continued)

*Primary Examiner* — Shawki S Ismail
*Assistant Examiner* — Jany Tran
(74) *Attorney, Agent, or Firm* — Treyz Law Group; G. Victor Treyz; David C. Kellogg

(57) ABSTRACT

An antenna may be formed from conductive regions that define a gap that is bridged by shunt inductors. The inductors may have equal inductances and may be located equidistant from each other to form a scatter-type antenna structure. The inductors may also have unequal inductances and may be located along the length of the gap with unequal inductor-to-inductor spacings, thereby creating a decreasing shunt inductance at increasing distances from a feed for the antenna. This type of antenna structure functions as a horn-type antenna. One or more scatter-type antenna structures may be cascaded to form a multiband antenna. Antenna gaps may be formed in conductive device housings.

21 Claims, 21 Drawing Sheets

U.S. PATENT DOCUMENTS

| | | | | |
|---|---|---|---|---|
| 7,239,290 | B2 | 7/2007 | Poilasne et al. | |
| 2003/0107518 | A1 | 6/2003 | Li et al. | |
| 2003/0117331 | A1* | 6/2003 | Schamberger et al. | 343/770 |
| 2003/0122721 | A1* | 7/2003 | Sievenpiper | 343/767 |
| 2004/0145521 | A1 | 7/2004 | Hebron et al. | |
| 2004/0160367 | A1 | 8/2004 | Mendolia et al. | |
| 2005/0222633 | A1* | 10/2005 | Edvardsson | 607/36 |
| 2006/0055606 | A1 | 3/2006 | Boyle | |
| 2008/0258985 | A1* | 10/2008 | Ryou et al. | 343/746 |

OTHER PUBLICATIONS

Hill et al. U.S. Appl. No. 11/821,192, filed Jun. 21, 2007.
Hill et al. U.S. Appl. No. 11/897,033, filed Aug. 28, 2007.
Zhang et al. U.S. Appl. No. 11/895,053, filed Aug. 22, 2007.
Chiang et al. U.S. Appl. No. 11/702,039, filed Feb. 1, 2007.
R. Bancroft "A Commercial Perspective on the Development and Integration of an 802.11a/b/g HiperLan/WLAN Antenna into Laptop Computers", IEEE Antennas and Propagation Magazine, vol. 48, No. 4, Aug. 2006, pp. 12-18.
B. Chiang et al. "Invasion of Inductor and Capacitor Chips in the Design of Antennas and Platform Integration", IEEE International Conference on Portable Information Devices, May 2007, pp. 1-4.
A. Lai et al. "Infinite Wavelength Resonant Antennas With Monopolar Radiation Pattern Based on Periodic Structures", IEEE Transactions on Antennas and Propagation, vol. 55, No. 3, Mar. 2007, pp. 868-876.

* cited by examiner

ANTENNAS WITH PERIODIC SHUNT INDUCTORS

This application is a continuation of patent application Ser. No. 11/958,824, filed Dec. 18, 2007 now U.S. Pat. No. 7,705,795, which is hereby incorporated by reference herein in its entirety.

BACKGROUND

This invention relates to antennas, and more particularly, to antennas that have shunt inductors at intervals along their lengths.

Antennas are widely used in modern electronic devices. For example, antennas are often used in portable electronic devices such as laptop computers and cellular telephones. Particularly in environments such as these, there is a premium placed on small size and high radiation efficiency. Antennas that are compact take up less space in a portable device than bulkier antennas, which allows a designer to enhance the portability of a device. Highly efficient antennas reduce the amount of battery drain that is imposed on a portable device.

It is sometimes desirable for an antenna to cover multiple frequency bands. This allows antenna hardware to be shared among multiple radio-frequency transceivers without providing too much antenna hardware in a device. Multiband antenna designs generally require antenna resonating structures that radiate over a wide range of frequencies or multiple radiators.

It would therefore be desirable to be able to provide antennas that cover one or more communications band without consuming too much space in an electronic device such as a portable electronic device.

SUMMARY

Antennas may be provided for electronic devices. The electronic devices may be portable electronic devices such as laptop computers. The antennas may have conductive regions that form positive and negative antenna poles. The poles may be separated by a dielectric-filled gap. For example, the poles may be planar strips or regions of metal or metal alloy that are separated by a gap of air several microns in width. The conductive regions that form the antenna poles may be part of a conductive housing for an electronic device. Because the gap is small, the gap may be invisible to the naked eye, allowing the antenna to be formed on an exterior housing surface.

Shunt inductors may bridge the antenna gap at various locations along the length of the antenna. The shunt inductors may be provided in the form of surface-mount devices (SMD).

The antenna may be fed using positive and negative antenna feed terminals. The shunt inductors may have equal inductances and may be located equidistant from each other to form a scatter-type antenna structure. The inductors may also have unequal inductances and/or may be located along the length of the gap with unequal inductor-to-inductor spacings, thereby creating a decreasing shunt inductance at increasing distances from the antenna feed terminals. This type of antenna structure functions as a horn-type antenna.

One or more scatter-type antenna structures may be cascaded to form a multiband antenna. A horn-type antenna structure may also be cascaded to add to the multiband nature of the antenna. Hybrid antennas may be thus formed from one or more scatter-type antenna structures and a horn-type antenna structure.

Further features of the invention, its nature and various advantages will be more apparent from the accompanying drawings and the following detailed description of the preferred embodiments.

DETAILED DESCRIPTION

Figure 1:
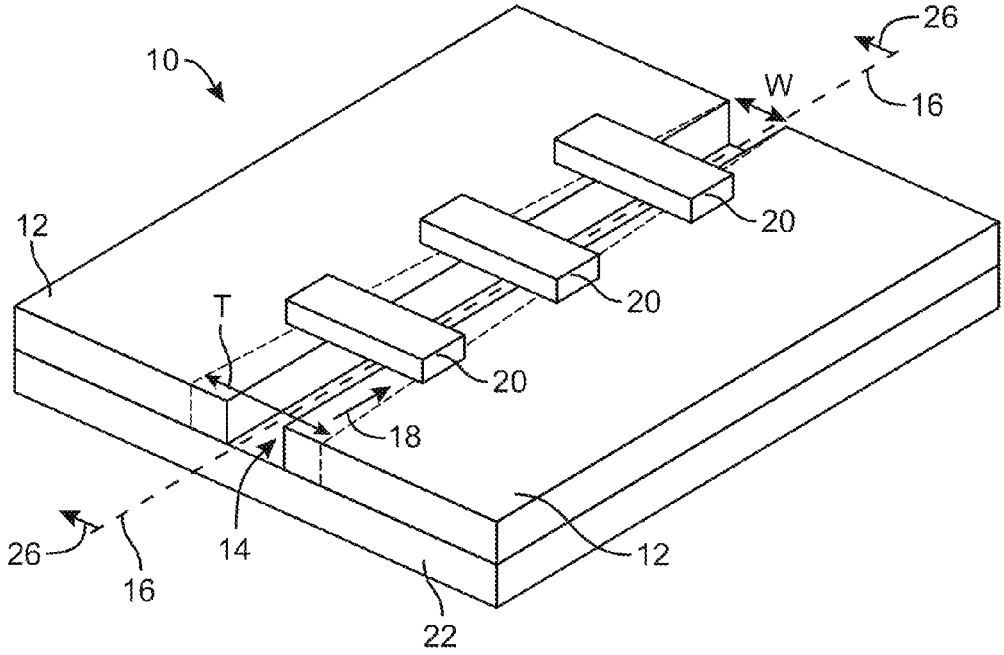
FIG. 1 is a perspective view of an illustrative antenna in accordance with an embodiment of the present invention.

The present invention relates to antennas for electronic devices. The electronic devices in which the antennas are used may be any suitable type of electronic equipment. For example, the electronic devices may include computers such as laptop computers, desktop computers, computers that are integrated into computer monitors, processing equipment that is part of a set-top box, handheld computers, etc. The antennas may be used in any suitable wireless communications circuitry in a wireless electronic device such as cellular telephone wireless communications circuitry or wireless communications circuitry for implementing local wireless data links (as examples).

The wireless electronic devices in which the antennas are used may or may not be portable. An example of a wireless electronic device that may not be considered portable is a large computer. Examples of wireless electronic devices that may be considered portable are portable electronic devices such as laptop computers or small portable computers of the type that are sometimes referred to as ultraportables.

Portable electronic devices may also be somewhat smaller devices such as handheld electronic devices. Examples of smaller portable electronic devices include wrist-watch devices, pendant devices, headphone and earpiece devices, and other wearable and miniature devices. Typical handheld devices may be, for example, cellular telephones, media players with wireless communications capabilities, handheld computers (also sometimes called personal digital assistants), remote controllers, global positioning system (GPS) devices, and handheld gaming devices. If desired, the antennas may be incorporated into hybrid devices that combine the functionality of multiple devices of these types. Examples of hybrid handheld devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

The antennas in these devices may support communications over any suitable wireless communications bands. For example, the antennas may be used to cover communications frequency bands such as the cellular telephone bands at 850 MHz, 900 MHz, 1800 MHz, and 1900 MHz, data service bands such as the 3G data communications band at 2170 MHz (commonly referred to as the UMTS or Universal Mobile Telecommunications System band), the Wi-Fi® (IEEE 802.11) bands at 2.4 GHz and 5.0 GHz (also sometimes referred to as wireless local area network or WLAN bands), the Bluetooth® band at 2.4 GHz, and the global positioning system (GPS) band at 1575 MHz. The 850 MHz band is sometimes referred to as the Global System for Mobile (GSM) communications band. The 900 MHz communications band is sometimes referred to as the Extended GSM (EGSM) band. The 1800 MHz band is sometimes referred to as the Digital Cellular System (DCS) band. The 1900 MHz band is sometimes referred to as the Personal Communications Service (PCS) band. Single band antennas may be used to cover individual bands. For example, a single band antenna may be used to cover the Wi-Fi® band at 2.4 GHz. Multiband antennas may be used to cover multiple communications bands. For example, a multiband antenna may be used to cover a Wi-Fi® band at 2.4 GHz and a Wi-Fi® band at 5.0 GHz.

Antennas in accordance with embodiments of the present invention may be very narrow (e.g., microns in width) and may be electrically very short (e.g., having a length less than a quarter of a wavelength at their operating frequency). An antenna of this type may be suitable form multiple antenna applications such as in multiple in multiple out (MIMO) high throughput communications systems, and phased arrays for high gain, steerable beam, adaptive beam systems.

The antenna may have a slot. The slot may be suitable for integration into conductor skins (e.g., thin metal housing walls) of various platforms, and may be integrated with other electronics to form skin-like complete systems. Its small aperture (slot area) may allow the antenna to be invisible at short distances, so it may blend into its immediate environment for cosmetic or covert applications.

The antenna may be used to provide communications and remote control capabilities for any metallic-skin-enclosed device (e.g., a valuable device) such as a device that might otherwise be cut off from the environment. For example, it may be desirable to enclose a computer in a metal enclosure for security or electromagnetic pulse (EMP) protection. The antenna can be placed in the enclosure wall to permit wireless communications through the enclosure.

An illustrative antenna in accordance with an embodiment of the present invention is shown in FIG. 1. As shown in FIG. 1, antenna 10 may have a gap 14 that is formed between two opposing conductive regions 12. In the example of FIG. 1, conductive regions 12 are planar and are formed on a substrate 22. Conductive regions 12 may be formed from any suitable conductive materials. Illustrative conductive materials from which conductive regions 12 may be formed include elemental metals such as gold and copper. Conductive regions 12 may also be formed from alloys such as metal alloys. Conductive materials that are formed from non-metal substances (e.g., semiconductors, conductive plastics, conductive ceramics, etc.) may also be used. The use of metallic conductive structures is sometimes described herein as an example. This is, however, merely illustrative. Conductive regions 12 may be formed from any suitable materials.

In a typical arrangement, a thin film or thin sheet of metal or metal alloy may be deposited on a substrate such as substrate 22 that is formed from dielectric. Illustrative dielectric materials that may be used for forming substrate 22 include glass, ceramic, and plastic. These are, however, merely illustrative examples. Any suitable substrate material may be used for antenna 10 if desired. If desired, antennas such as antenna 10 may be formed without using dielectric substrate 22. For example, gap 14 may be formed in a piece of conductive material that does not require a dielectric support. Antennas of this type and antennas with dielectric substrates may be coated with coatings (e.g., protective dielectric coatings).

Gap 14 may have an equal width W along its length or may be tapered. In tapered antenna arrangements, the electrical properties of the antenna may vary as a function of location along longitudinal axis 16. For example, the impedance of the antenna is generally affected by the inherent (parasitic) shunt capacitance associated with the opposing conductive regions 12. Conductive regions 12 may be considered to form a parallel plate capacitor. Because the capacitance of this type of structure is dependent on the separation between the plates, the capacitance of antenna 10 per unit length will generally be constant in arrangements in which width W is constant along the antenna's length and will generally vary in arrangements in which width W varies along the antenna's length. An example of an arrangement in which gap 14 has a tapered width (e.g., a width that varies from width W to width T) is illustrated by dashed lines in FIG. 1.

Antenna 10 may have a number of shunt inductors 20 that bridge gap 14. Inductors 20 may be formed from patterned conductor (e.g., metal or metal alloys that have been pattered using semiconductor fabrication techniques). In one particularly suitable arrangement, inductors 20 are formed from discrete surface-mount components. Surface mount components are compact (e.g., less than a millimeter in their largest lateral dimension) and may be assembled using machine-assisted manufacturing techniques (if desired). The values of inductors 20 are typically in the nH range (e.g., 1-1000 nH). Inductors 20 may also be bonded beneath or to the underside of conductive regions 12, which, for this illustrative example, would be in substrate 22.

Electromagnetic radiation may be emitted from antenna 10 when antenna 10 is being used to transmit radio-frequency (RF) signals. In this type of configuration, electromagnetic waves may travel along gap 14 in direction 18. Electromagnetic radiation may also be received by antenna 10 (e.g., when antenna 10 is being used to receive incoming RF signals) due to the reciprocity of linear electrical components. It is not necessary for antenna 10 to operate in both transmitting and receiving modes. For example, an antenna may be used to receive global positioning system (GPS) signals without transmitting any signals. In a typical arrangement, however, antenna 10 may be used to transmit and receive RF signals (e.g., for cellular telephone or data communications).

Figure 2:
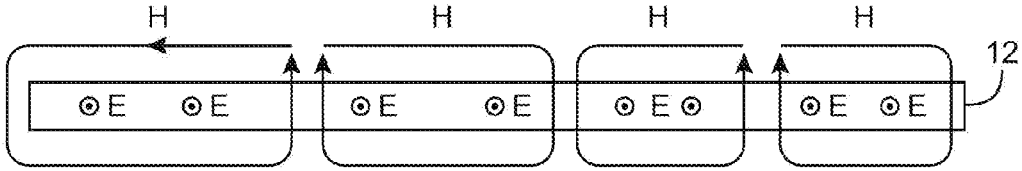
FIG. 2 is a cross-sectional side view of an antenna in accordance with an embodiment of the present invention.

Antennas such as the illustrative antenna of FIG. 1 support a zero-order transverse electric field mode (sometimes referred to as the $TE_0$ mode) as in slot lines and slot antennas. The configuration of the electric field E and magnetic field H in this mode are shown in FIG. 2. FIG. 2 contains a cross-sectional side view of an antenna of the type shown in FIG. 1 taken along longitudinal axis 16 and viewed in direction 26. Inductors 20 are not shown in FIG. 2 to avoid over-complicating the drawing. As shown in FIG. 2, electric field E extends directly across gap 14 and magnetic field H forms loops in the plane of gap 12 (i.e., in the page in the orientation of FIG. 2). The $TE_0$ mode is distinct from the TEM mode, so the treatment of slot lines and conventional transmission lines are also different.

A typical antenna is on the order of millimeters in length (e.g., a fractional wavelength to several wavelengths). A typical width W for gap 14 may be on the order of microns. Gaps that are of this size may be invisible to the naked eye. As a result, antennas such as antenna 10 of FIG. 1 may be formed in plain sight of a user of an electronic device without actually being visible (or at least being unnoticeable under normal observation). This allows antenna 10 to be formed in locations that would otherwise be obtrusive if antenna 10 were larger and visible. For example, antenna 10 may be formed as an integral part of a conductive housing in an electronic device. If the electronic device has a conductive housing (e.g., a metal case or stand), the gap for the antenna may be formed directly in the conductive housing (or other such conductive structure).

Figure 3:
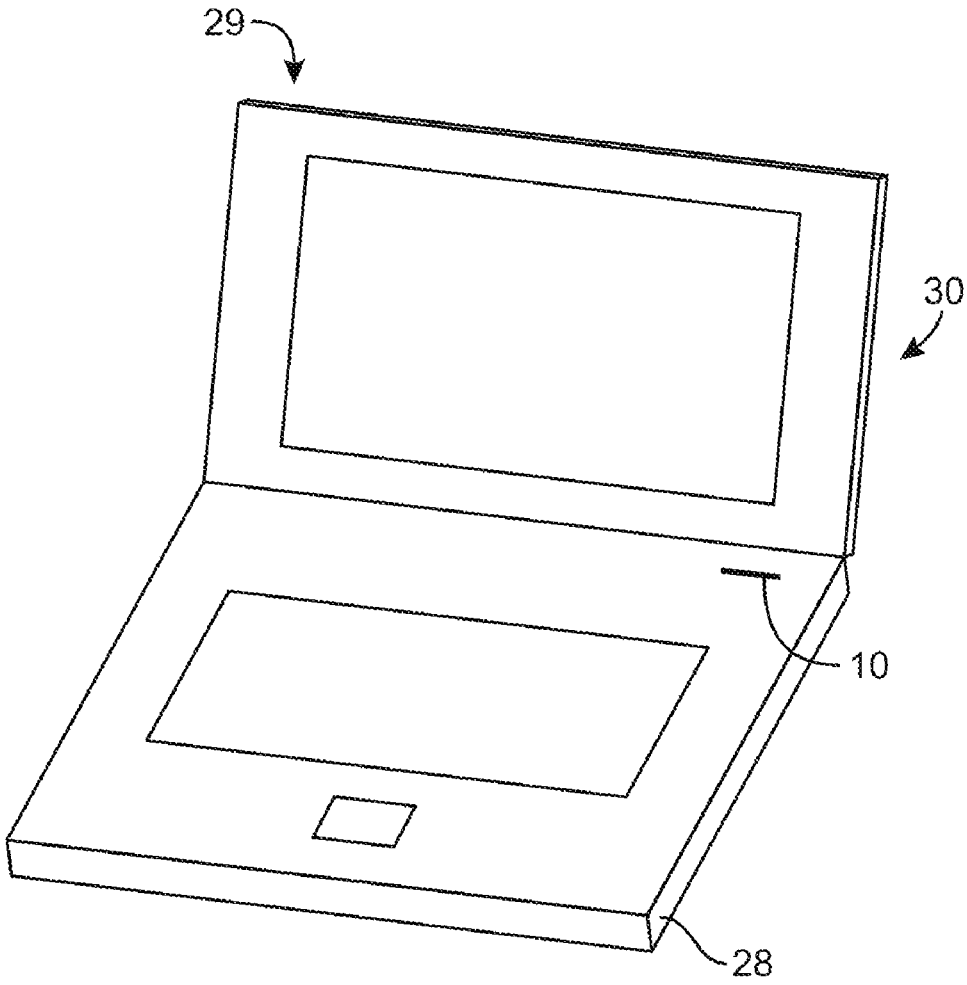
FIG. 3 is a perspective view of an illustrative portable electronic device containing an antenna in accordance with an embodiment of the present invention.

An example is shown in FIG. 3. As shown in FIG. 3, antenna 10 may be formed in housing 28 of laptop computer 30. Antenna 10 may be formed in any suitable portion of housing 28. For example, antenna 10 may be formed in the top lid of laptop computer 30 (e.g., on outer surface 29 of the top lid), may be formed as part of or adjacent to a conductive logo structure, may be formed as part of a sidewall or lower housing portion of laptop computer 30, etc. If laptop computer 30 or other electronic device has a conductive housing such as a thin sheet of metal or metal alloy, inductors 20 (FIG. 1) may be mounted on the inside of the housing.

Figure 4:
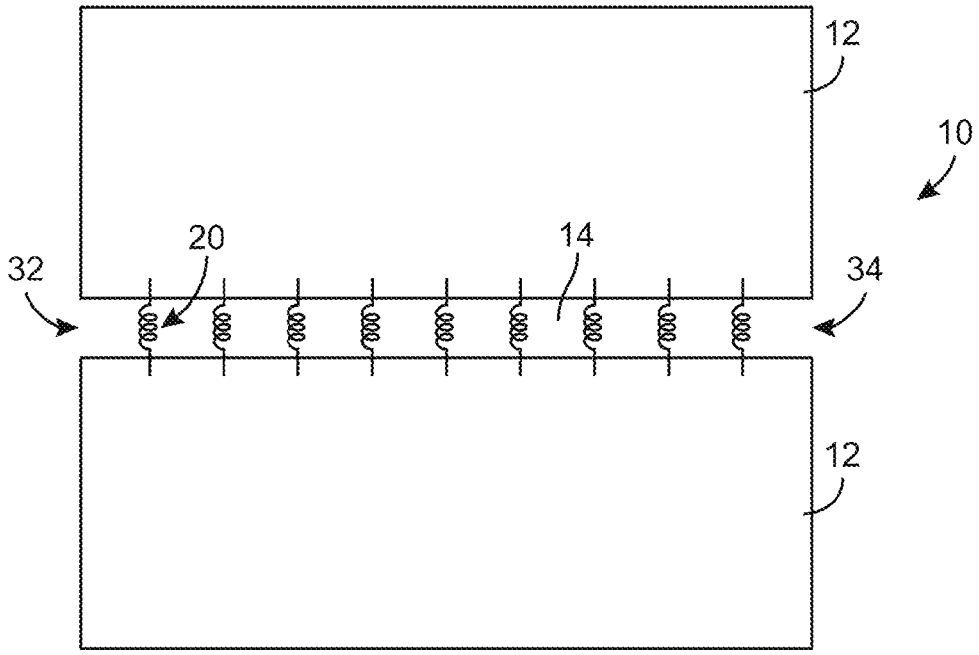
FIG. 4 is a top view of an illustrative antenna showing how the antenna may be formed from a slot with two open ends that is bridged by inductors and that forms a gap in accordance with an embodiment of the present invention.

As shown in FIG. 4, antenna 10 may be constructed from a slot that has open ends 32 and 34. In this type of arrangement, gap 14 may be bridged by inductors 20 (which are shown schematically) at intervals along its length. Because the slot of antenna 10 forms gap 14, antennas of the type shown in FIG. 4 are sometimes referred to as slot antennas or gap antennas (regardless of whether gap 14 has open ends).

Figure 5:
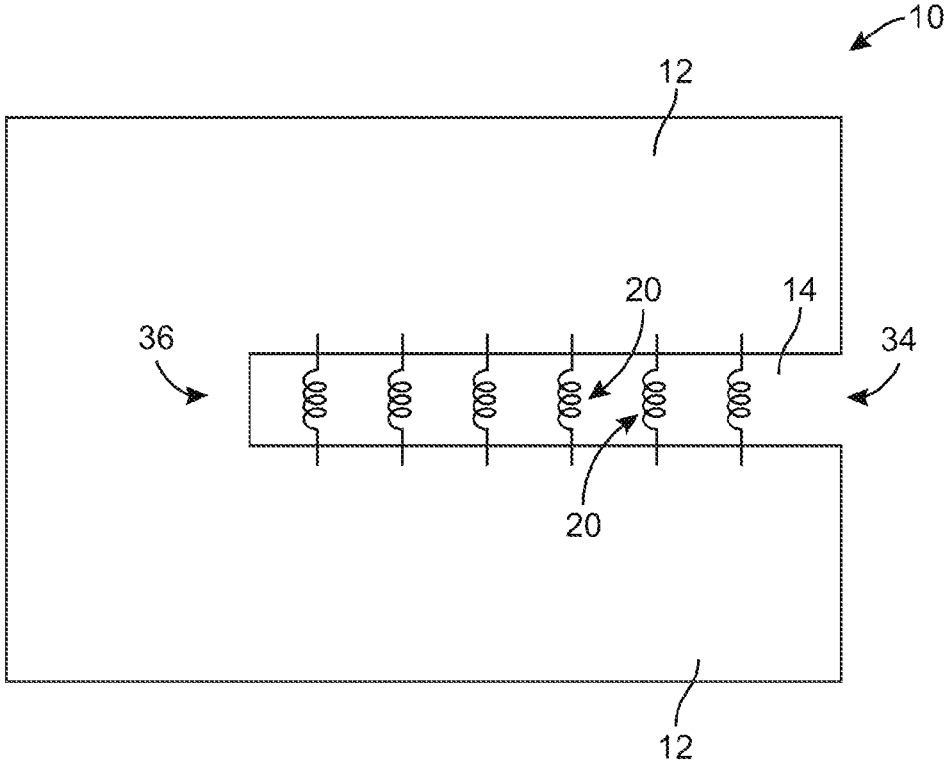
FIG. 5 is a top view of an illustrative antenna showing how the antenna may be formed from a slot with one open end that is bridged by inductors and that forms a gap in accordance with an embodiment of the present invention.

As shown in FIG. 5, the slot from which gap 14 is formed may have one open end (end 34) and one closed end (end 36).

Figure 6:
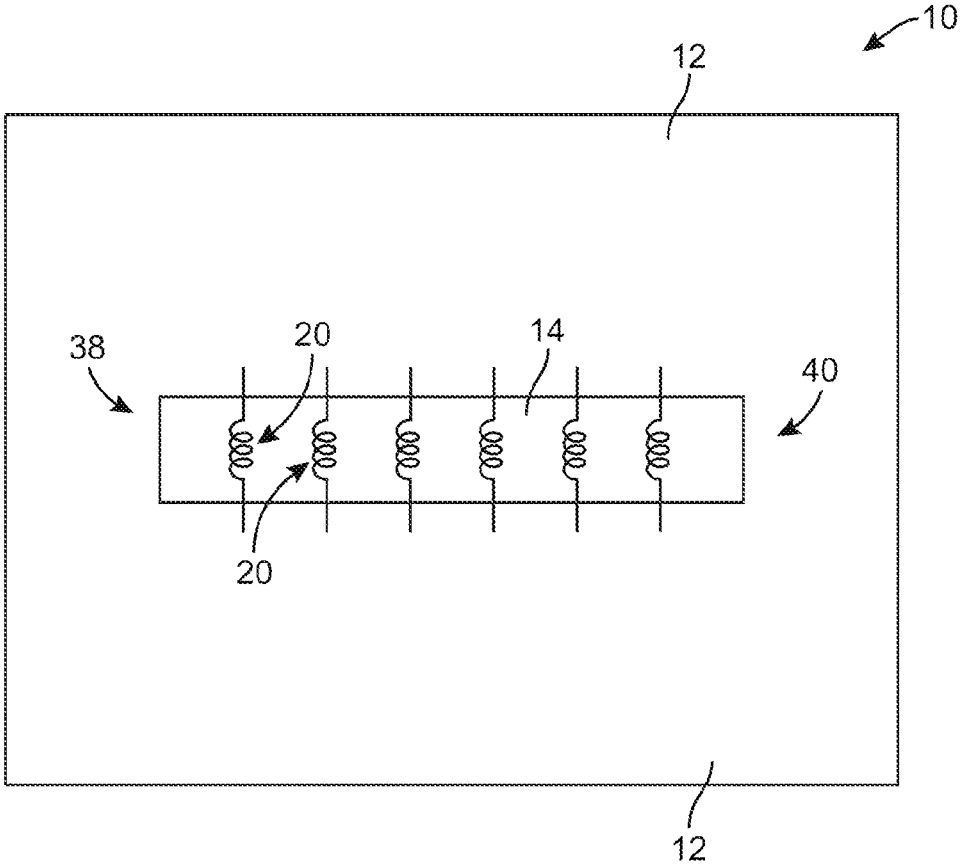
FIG. 6 is a top view of an illustrative antenna showing how the antenna may be formed from a slot with closed ends that is bridged by inductors and that forms a gap in accordance with an embodiment of the present invention.

In the illustrative arrangement shown in FIG. 6, antenna 10 has two closed ends (ends 38 and 40). Regardless of the type of gap or slot that is used to form antenna 10, antenna 10 may still be considered to have two poles. For example, in the arrangement of FIG. 1, one pole (e.g., a ground or negative pole) of antenna 10 may be formed by one of conductive regions 12 and another pole (e.g., a positive pole) of antenna 10 may be formed by the other one of conductive regions 12. This nomenclature may be used for regions 12 of other antenna arrangements, including slot antenna arrangements of the types shown in FIGS. 5 and 6 in which one or both ends of the slot are closed.

If desired, antennas with shunt inductors may be formed from waveguides that support transverse electromagnetic (TEM) field modes. Examples of this type of structure are shown in FIGS. 7-9.

Figure 7:
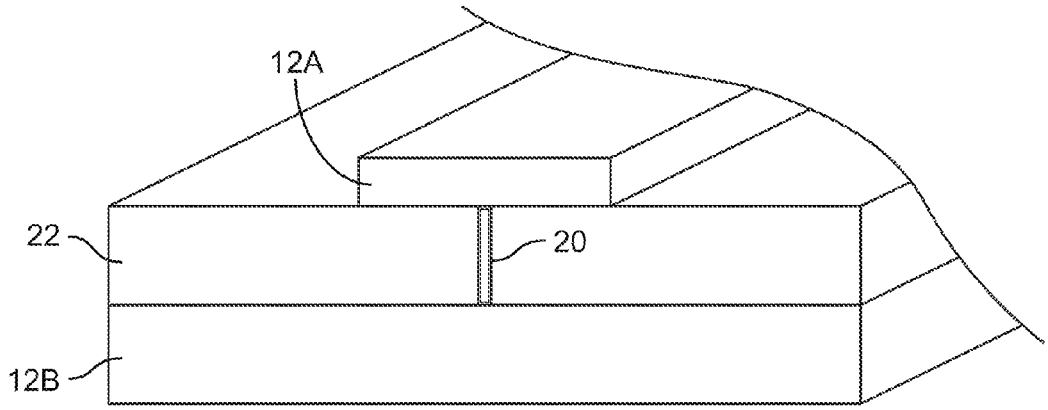
FIG. 7 is a sectional perspective end view of an illustrative microstrip antenna with shunt inductors in accordance with an embodiment of the present invention.

FIG. 7 shows an illustrative microstrip antenna 10 that is formed from a positive strip-shaped conductive region (pole) 12A formed on a planar ground conductive region (pole) 12B. Interposing dielectric layer 22 may be used to separate poles 12A and 12B. In this type of configuration, conductive vias may be used to form inductors 20. Conductive vias, which are shown in cross-section in FIG. 8, may be formed from metal or metal alloys. The holes for the vias may be formed by semiconductor fabrication techniques (e.g., etching). The via conductors may be deposited by sputter deposition (as an example).

Figure 9:
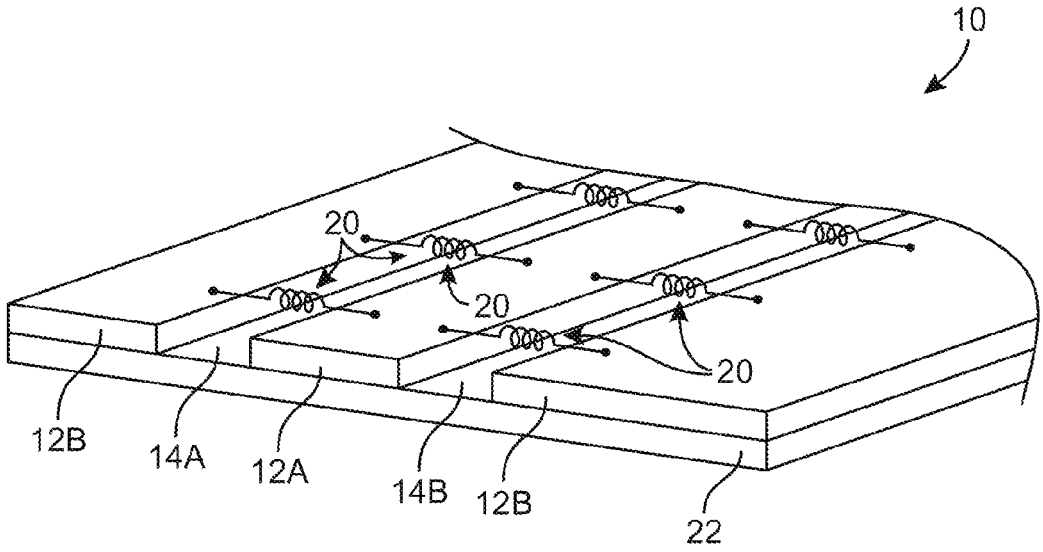
FIG. 9 is a perspective view of an illustrative coplanar waveguide antenna with shunt inductors in accordance with an embodiment of the present invention.

FIG. 9 shows an illustrative coplanar waveguide antenna 10 that is formed from a strip-shaped center conductor 12A and two planar side conductors 12B. Shunt inductors 20, which may be formed from surface mounted components as described in connection with FIG. 1, may be mounted on the conductive regions of antenna 10 so that gaps 14A and 14B are both bridged. Antenna 10 of FIG. 9 may have a dielectric support structure 22 or may be formed without dielectric 22 (e.g., by forming dual gaps 14A and 14B as an integral portion of a conductive device housing.

Figure 8:
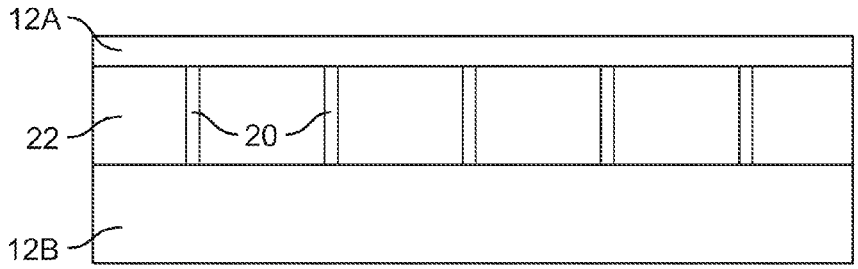
FIG. 8 is a cross-sectional side view of an antenna of the type shown in FIG. 7 in accordance with an embodiment of the present invention.
Figure 10:
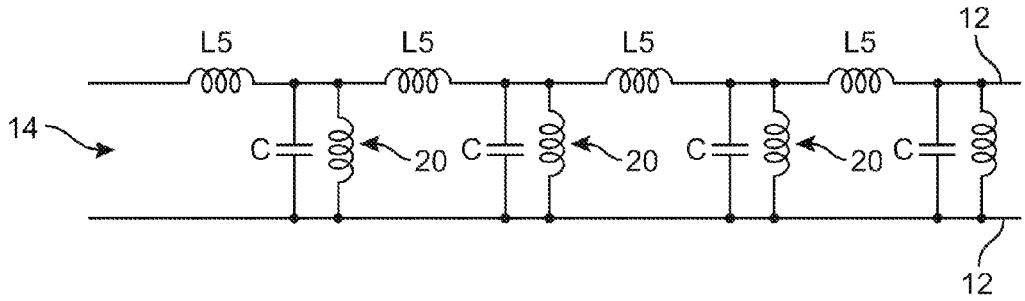
FIG. 10 is an equivalent circuit of an illustrative antenna such as a microstrip or coplanar waveguide antenna that supports operation in a transverse electromagnetic (TEM) propagation mode in accordance with an embodiment of the present invention.
Figure 11:
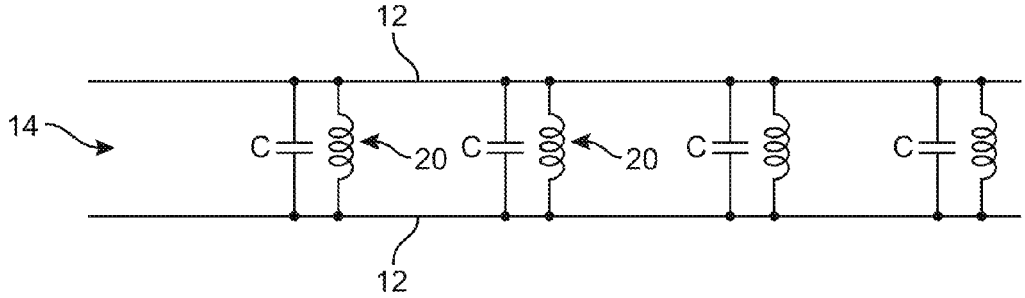
FIG. 11 is an equivalent circuit of an illustrative antenna such as a gap antenna that supports operation in a zero-order transverse electric field mode ($TE_0$) in accordance with an embodiment of the present invention.

Microstrip antenna 10 of FIG. 8 and coplanar waveguide antenna 10 of FIG. 9 are examples of TEM-type waveguides, whereas the gap antennas of FIGS. 4, 5, and 6 are examples of $TE_0$-type antennas. An equivalent circuit for a TEM-type antenna is shown in FIG. 10. An equivalent circuit for a $TE_0$-type antenna is shown in FIG. 11. As shown in the equivalent circuits of FIGS. 10 and 11, there is generally a parasitic capacitance C associated with a unit length of either antenna type. TEM-type antennas typically exhibit a series inductance LS per unit length. In contrast, $TE_0$-type antennas have zero (negligible) amounts of series inductance. Each shunt inductor 20, in combination with the parasitic capacitance C per unit length in the antenna, creates an impedance discontinuity that generates radiative scattering. At this impedance discontinuity, the impedance of the shunt inductor-capacitor combination tends to infinity. The abruptness of this impedance discontinuity can be used to efficiently scatter antenna radiation.

An advantage of the $TE_0$-type antenna configuration of FIG. 11 is that it does not exhibit significant series inductance. In TEM antennas of the type shown in FIG. 10, the inductances LS produce a phase delay between successive inductors 20. This phase delay causes the radiation scattering pattern to exhibit a less omnidirectional behavior than in $TE_0$ antenna arrangements of the type shown in FIG. 11. Although either type of antenna or combinations of these antenna types may be used in forming antenna 10, arrangements in which antenna 10 is based on a $TE_0$ configuration are sometimes described herein as an example.

Antennas 10 (either TEM or $TE_0$) are preferably open structure transmission line antennas in which signals are fed to opposing positive and negative (ground) poles of the antenna and in which the positive pole is not encircled by the ground poles so as to prevent radiation.

Figure 12A:
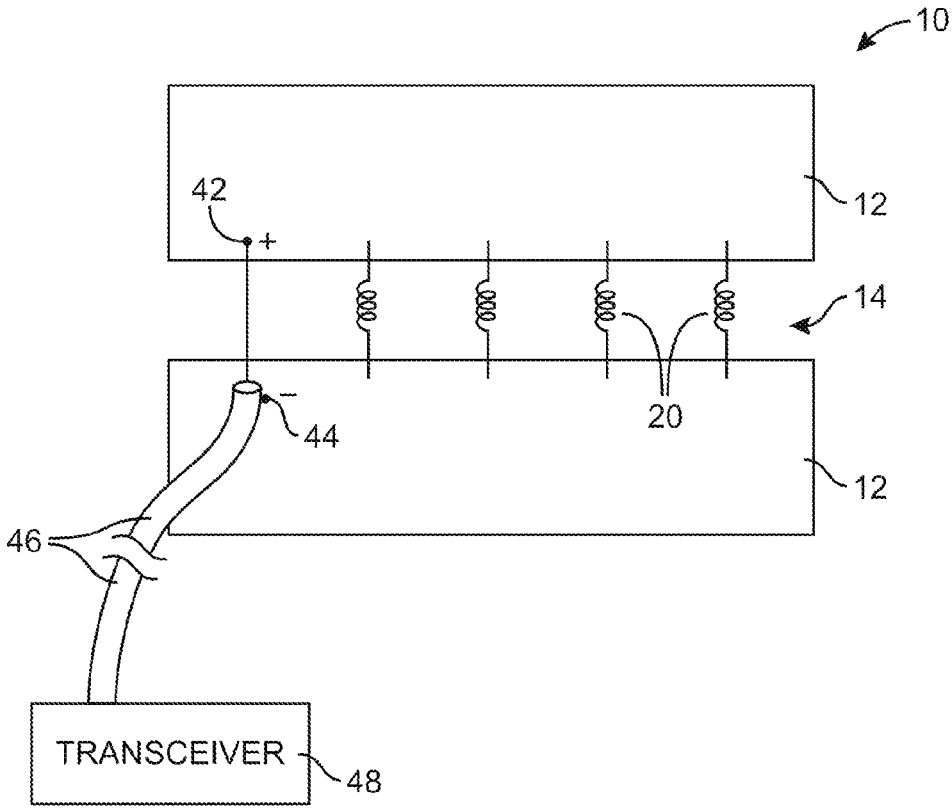
FIG. 12A is a top view of an antenna showing how the antenna may be fed at antenna feed terminals in accordance with an embodiment of the present invention.

Any suitable feed arrangement may be used for antenna 10. An illustrative feed arrangement is shown in FIG. 12A. As shown in the example of FIG. 12A, a transmission line such as coaxial transmission line 46 may be used to convey radio-frequency signals between antenna 10 and a radio-frequency transceiver such as radio-frequency transceiver 48. Transceiver 48 may include one or more transceiver circuits for handling communications in one or more discrete communications bands. For example, transceiver 48 may be used to handle communications for one or more cellular telephone or 3G data bands and/or one or more local data bands such as Bluetooth, Wi-Fi, etc.

Transmission line 46 may be coupled to antenna 12 at feed terminals such as feed terminals 44 and 42. Feed terminal 44 may be referred to as a ground or negative feed terminal and may be shorted to the outer (ground) conductor of transmission line 46. Feed terminal 42 may be referred to as the positive antenna terminal. If desired, other types of antenna coupling arrangements may be used (e.g., based on near-field coupling, using impedance matching networks, etc.).

Figure 12B:
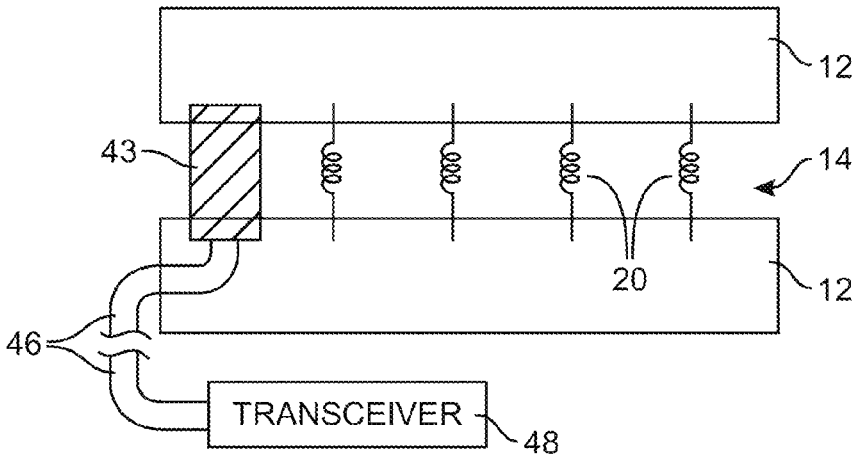
FIG. 12B is a top view of an antenna showing how the antenna may be fed using a matching network that includes a balun and/or an impedance transformer in accordance with an embodiment of the present invention.

As shown in FIG. 12B, the feed arrangement for antenna 10 may include a matching network such as matching network 43. Matching network 43 may include a balun (to match an unbalanced transmission line to a balanced antenna) and/or an impedance transformer (to help match the impedance of the transmission line to the impedance of the antenna).

Figure 13:
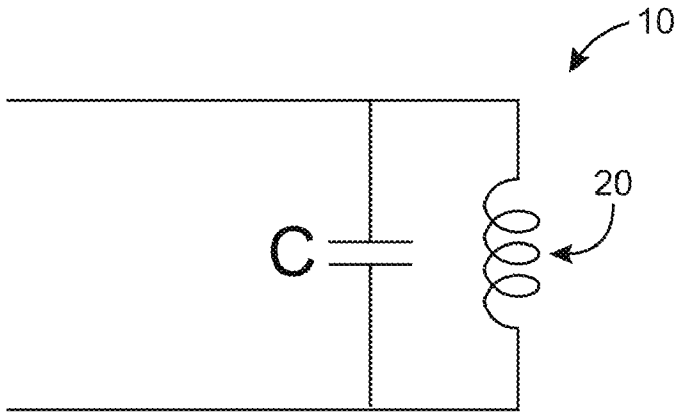
FIG. 13 is a circuit diagram of a portion of an illustrative antenna with a shunt inductance in accordance with an embodiment of the present invention.

A circuit diagram of a unit cell of antenna 10 is shown in FIG. 13. Inductor 20 may be formed by a component such as a surface-mounted component. Capacitor C may be the parasitic capacitance associated with a segment of the antenna (i.e., the capacitance formed by a length of the opposing portions of conductor across gap 14).

Figure 14:
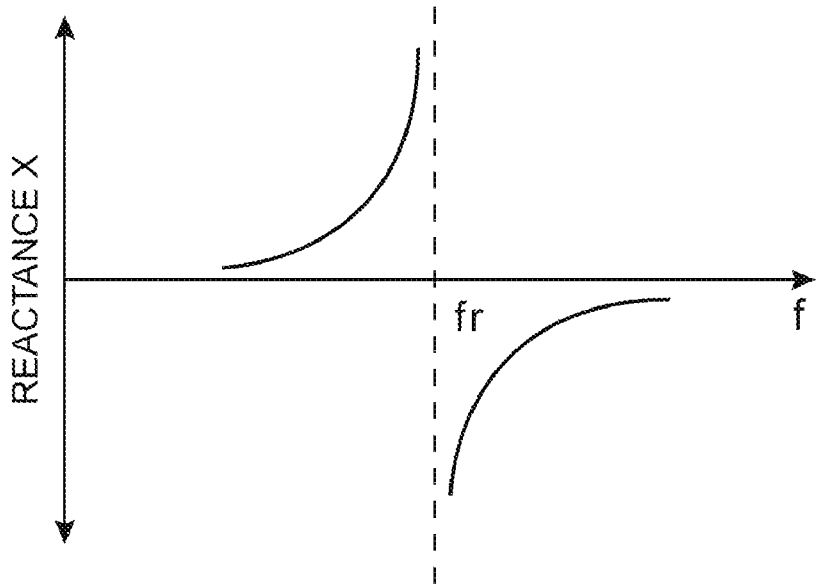
FIG. 14 is a graph of the reactance of the circuit of FIG. 13 plotted as a function of frequency in accordance with an embodiment of the present invention.

The circuit of FIG. 13 forms a resonant circuit. The reactance X of a circuit of the type shown in FIG. 13 as a function of signal frequency is shown in FIG. 14. Reactance X is positive for signal frequencies f below resonant frequency fr and is negative for signal frequencies f above resonant frequency fr. Graphs of the type shown in FIG. 14 may be used to analyze the radiative properties of antennas 10 that are formed with inductors 20 in different configurations.

Figure 15:
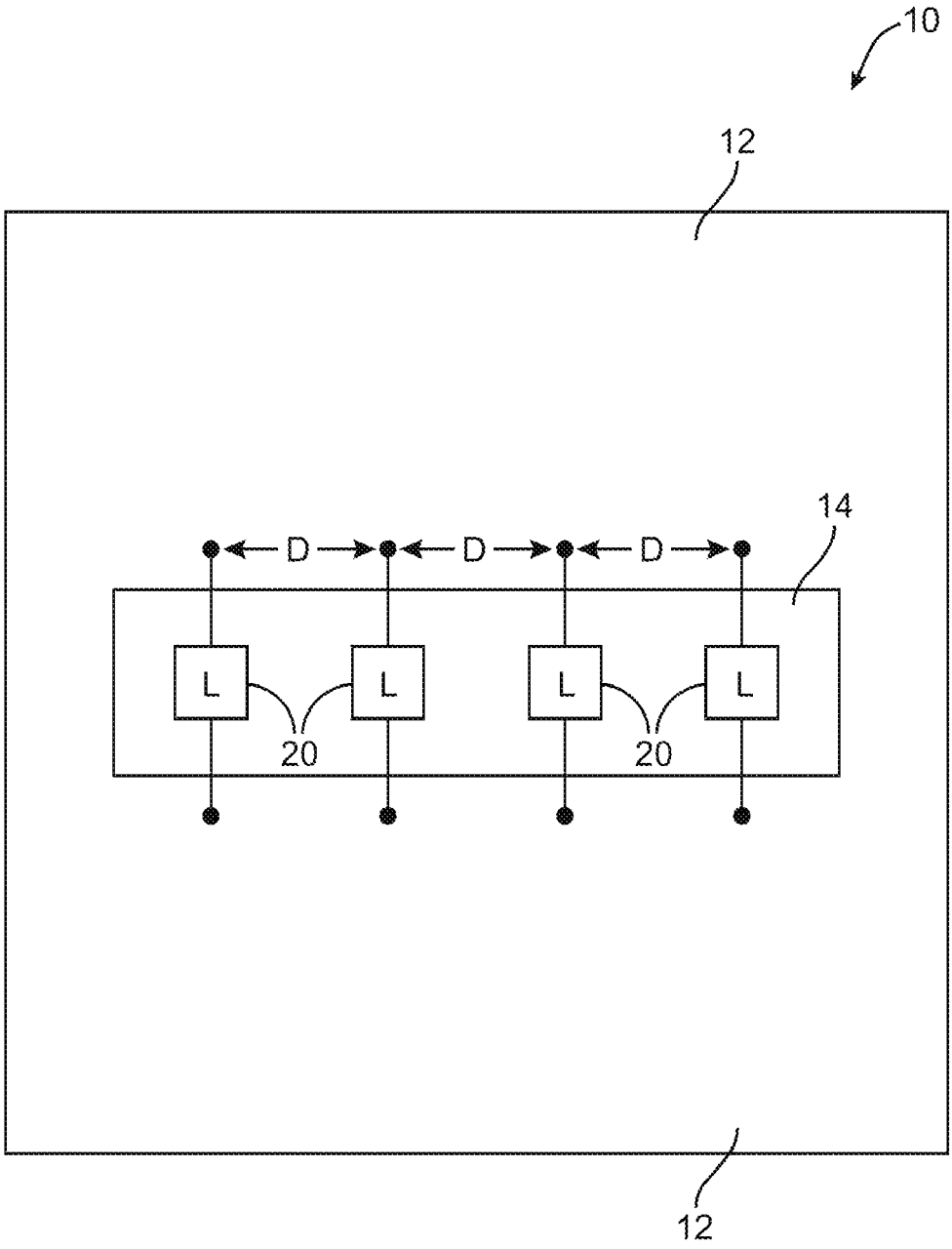
FIG. 15 is a top view of an illustrative antenna with shunt inductors showing how inductors with the same inductance value may be placed at even intervals along the length of the antenna in accordance with an embodiment of the present invention.

One suitable configuration for inductors 20 is shown in FIG. 15. In this type of arrangement, inductors 20 of inductance L are located along the length of gap 14 at equally spaced positions. Each inductor 20 may be separated by a distance D from adjacent inductors 20. Distance D may be, for example, a fraction of a millimeter. As waves pass each shunt inductor, electromagnetic radiation is scattered from the impedance discontinuity that is formed by the inductor. Antenna structures with this type of configurations are sometimes referred to as scatter-type antenna structures. These antennas tend to exhibit broad bandwidths and high efficiencies.

A single communications band or multiple communications bands may be supported using antennas of the type shown in FIG. 15. There are only four inductors in the example of FIG. 15, but this is merely illustrative. Antennas 10 may have any suitable number of inductors 20.

Figure 16:
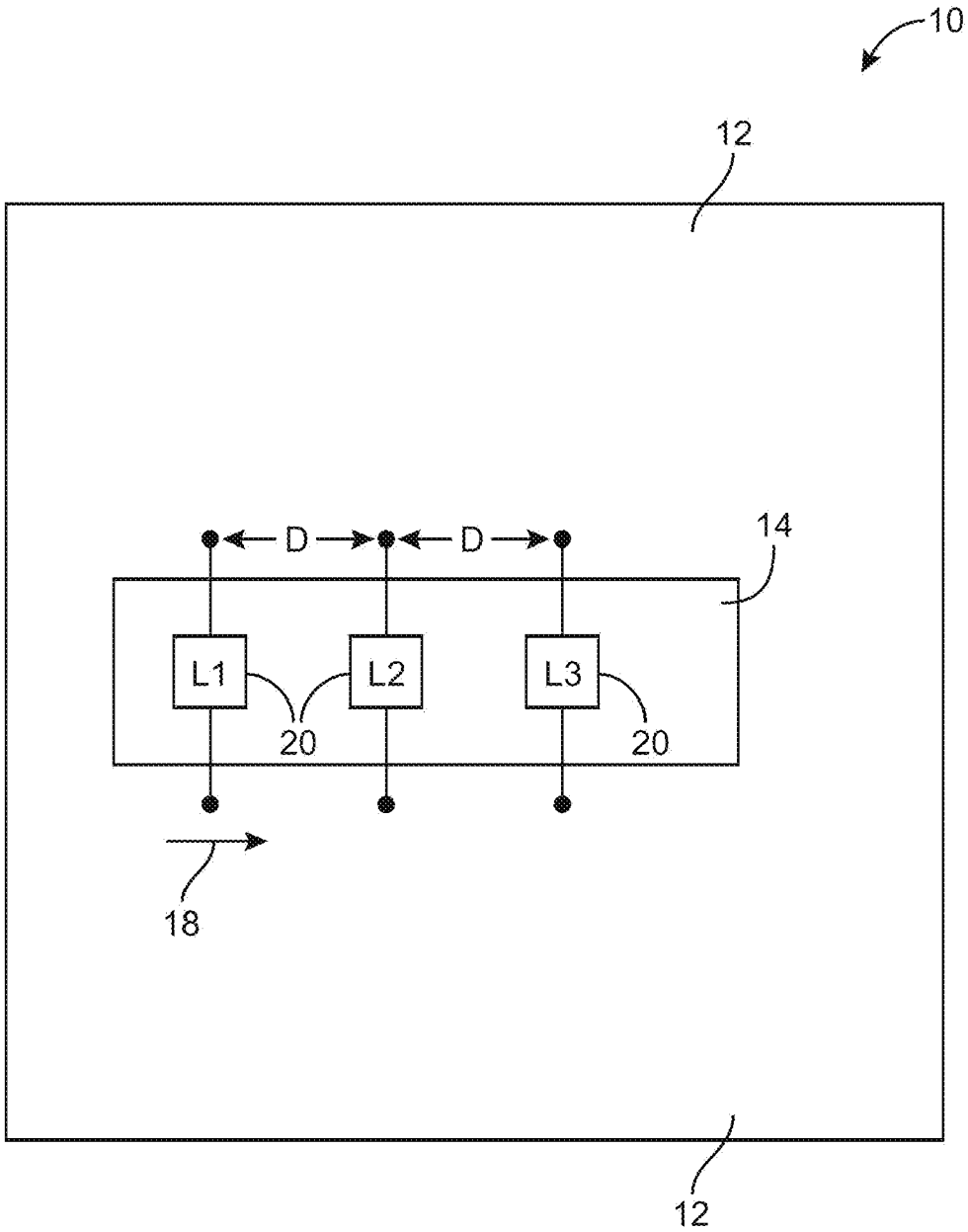
FIG. 16 is a top view of an illustrative antenna with shunt inductors showing how shunt inductors having different inductance values may be placed at even intervals along the length of the antenna in accordance with an embodiment of the present invention.

Another suitable configuration for conductors 20 is shown in FIG. 16. In the arrangement of FIG. 16, antenna 10 has three shunt inductors 20, having respective inductance values of L1, L2, and L3. These inductors may be evenly spaced along the gap 14 (e.g., with spacing D). The values of L1, L2, and L3 may decrease in the direction of travel 18 of a transmitted electromagnetic wave. For example, the values of L1, L2, and L3 may respectively be 64 mH, 32 mH, and 16 mH.

Figure 17:
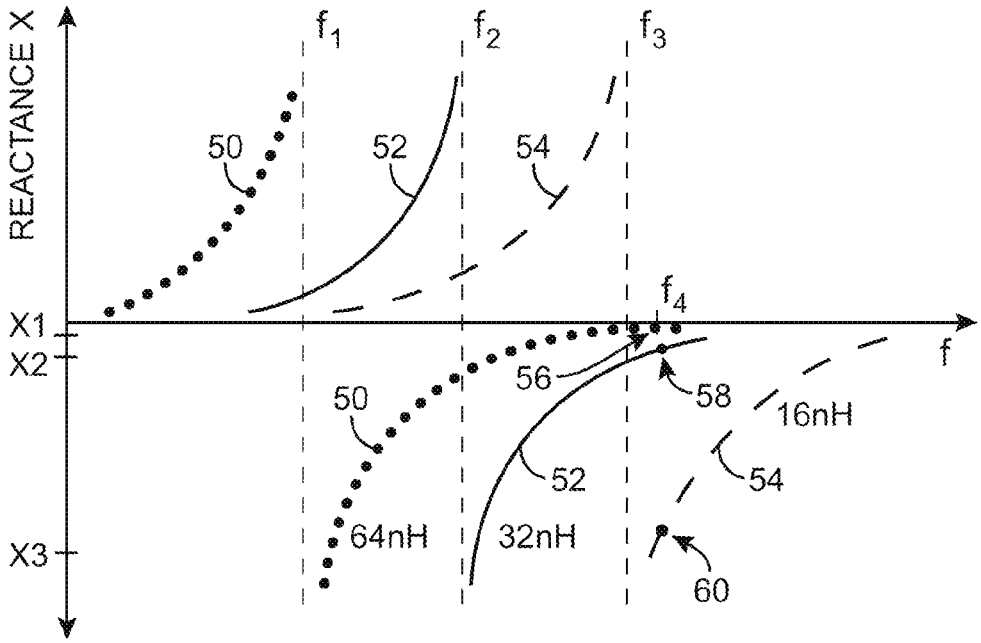
FIG. 17 is a graph showing the reactance of an antenna of the type shown in FIG. 16 as a function of signal frequency in accordance with an embodiment of the present invention.

A graph of the reactance of each inductor 20 as a function of frequency is shown in FIG. 17. As shown in FIG. 17, inductor L1 may be characterized by reactance curve 50, inductor L2 may be characterized by reactance curve 52, and inductor L3 may be characterized by reactance curve 54. At a given operating frequency (e.g., frequency f4 in the FIG. 17 example), the reactance X of signals in antenna 10 may increase in direction 18 along gap 14. In particular, the reactance of signals in antenna 10 may vary as a function of position along gap 14 at frequency f4 as shown by reactance values 56, 58, and 60. This increase of reactance value X as a function of position along the length of antenna 10 shows that antenna 10 has the characteristics of a horn antenna (e.g., a Vivaldi horn antenna). A horn antenna (which could also be formed by increasing the width W of gap 14 as a function of distance in direction 18) may exhibit increased efficiency, because the flare in the horn helps to impedance match transmission line 46 to free space. Antennas structures for antenna 10 in which the inductance values of inductors 20 vary as a function of length to create a horn-type antenna characteristic are sometimes referred to herein as horn-type antenna structures.

Figure 18:
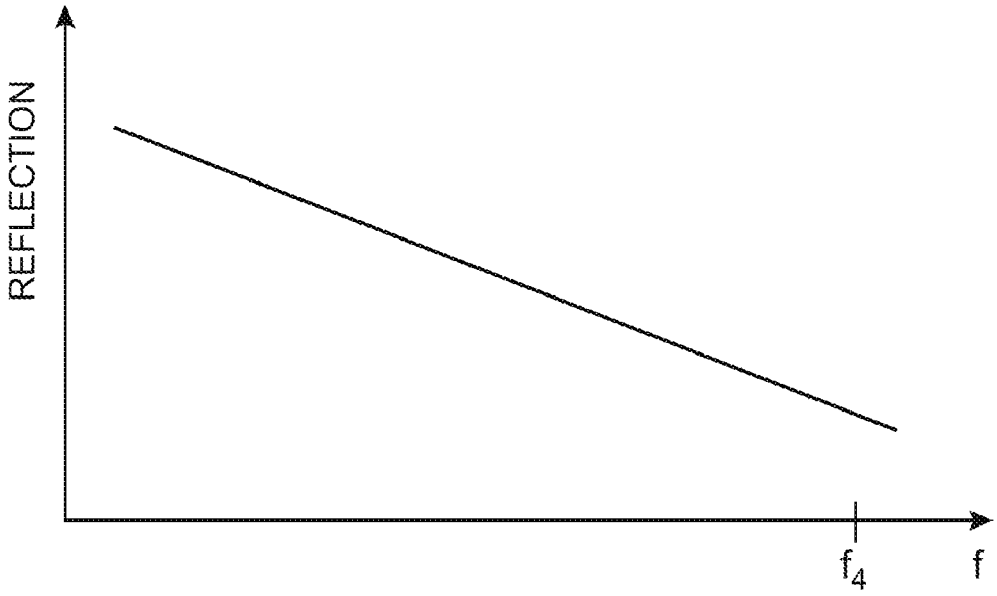
FIG. 18 is a graph in which the reflection coefficient of an illustrative antenna with shunt inductors has been plotted as a function of frequency in accordance with an embodiment of the present invention.

Reflectance coefficient calculations have been performed for horn-type antennas 10. As shown by the illustrative reflectance coefficient graph of FIG. 18, there may be only a relatively small amount of reflection at operating frequency f4, indicating that horn-type antennas can perform efficiently, as with the scatter-type antennas such as the antenna of FIG. 15.

Figure 19:
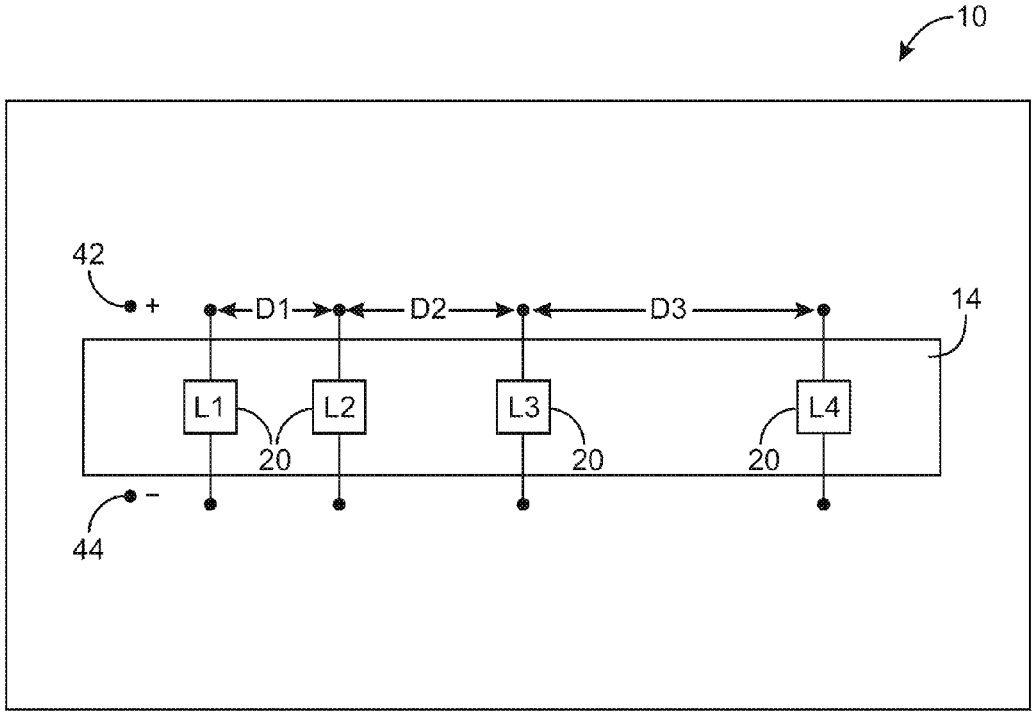
FIG. 19 is a top view of an illustrative antenna having shunt inductors placed at unequally separated locations along the length of the antenna in accordance with an embodiment of the present invention.

If desired, a horn-type antenna can be implemented by varying the spacing between shunt inductors 20 along the length of antenna gap 14. This type of arrangement is shown in FIG. 19. As shown in FIG. 19, antenna 10 may have shunt inductors 20 that are spaced unequally from each other. In the example of FIG. 19, the longitudinal separation D2 between the second and third inductors 20 of antenna 10 may be greater than the longitudinal separation D1 between the first and second inductors 20. Similarly, the longitudinal separation D3 between the third and fourth inductors 20 of antenna 10 may be greater than the longitudinal separation D2. The antenna feed may be located across terminals 42 and 44. Because the distances between respective inductive elements increases with increasing distance from the antenna feed terminals, the shunt inductance per unit length is effectively decreasing with increasing distance along the longitudinal axis of gap 14 away from the feed terminals. Even if inductances L1, L2, L3, and L4 are all equal in value, the increasing inductor-to-inductor spacing has the effect of decreasing the shunt inductance value, as with the horn-type arrangement described in connection with FIG. 16. The use of increasing spacing arrangements of the type shown in FIG. 19 therefore represents an alternative technique for forming horn-type antennas.

In a horn-type arrangement of the type shown in FIG. 19, the inductance values L1, L2, L3, and L4 may be equal. An arrangement of this type may be advantageous, because it can be relatively straightforward to match inductance values in a batch of inductors. The properties of antenna 10 may then be precisely controlled by controlling the spacings D1, D2, and D3.

If desired, a horn-type antenna structure may be formed in which inductance values L1, L2, L3, and L4 decrease and in which some or all of the inductor-to-inductor lateral spacings D1, D2, and D3 vary as described in connection with FIG. 19.

Hybrid layouts are also possible in which a mixture of spacings are used (increasing, decreasing, or equal) and a mixture of inductance values (increasing, decreasing, or equal) are used. When the effective shunt inductance per unit length decreases with increasing distance from the antenna feed, a horn-type antenna structure is produced. When the effective shunt inductance per unit length is equal, a scatter-type antenna structure is produced.

Antenna 10 may contain a single antenna type (e.g., a single scatter-type structure or a single horn-type structure) or may contain multiple such structures (e.g., two or more scatter-type structures, two or more horn-type structures, or a mixture of one or more scatter-type structures and one or more horn-type structures.

Figure 20:
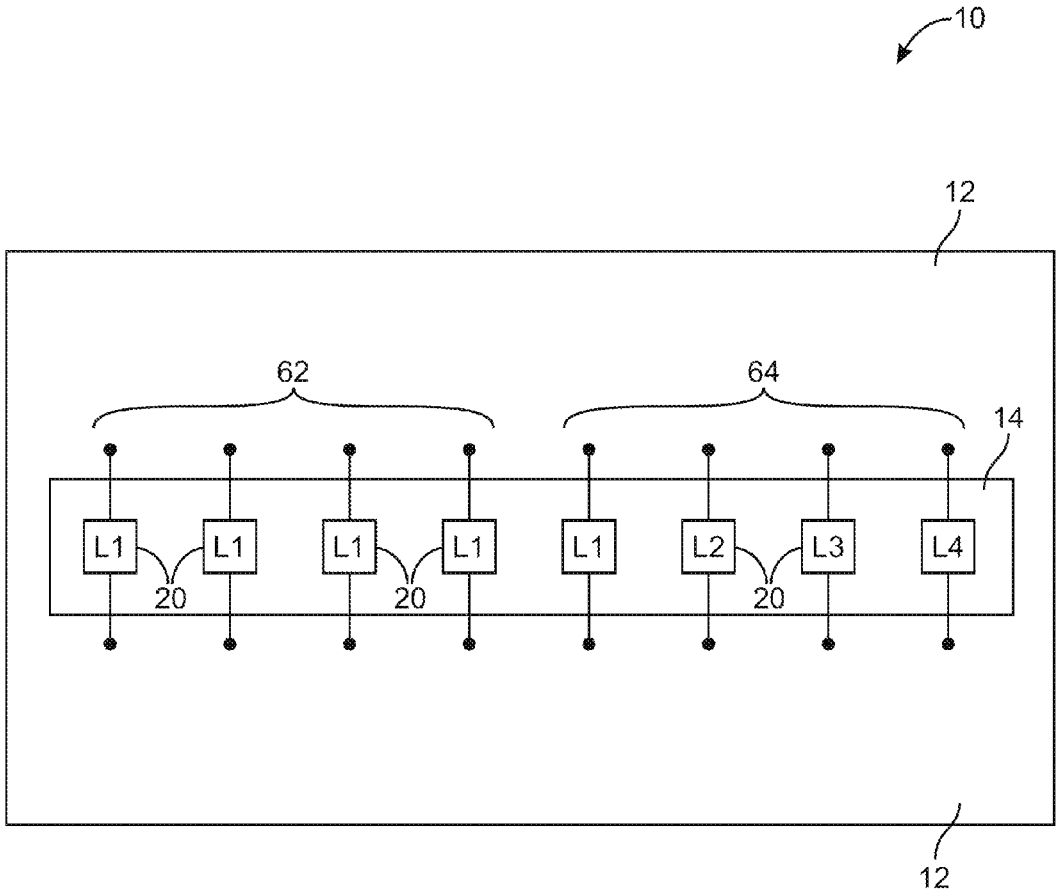
FIG. 20 is a top view of an illustrative antenna having a first portion in which shunt inductors of a first value are placed at equally spaced locations along the antenna length and having a second portion in which shunt inductors of a second value are placed at equally spaced locations along the antenna length in accordance with an embodiment of the present invention.

An illustrative configuration is shown in FIG. 20. In the example of FIG. 20, antenna 10 has a first portion and a second portion. First portion 62 may be a scatter-type antenna having shunt inductances of inductance L1. Second portion 64 may be a horn-type antenna having successively decreasing shunt inductances L1, L2, L3, and L4 or may be a horn-type antenna having equal inductance values L with increasing inductor-to-inductor spacings or may be a hybrid device with a mixture of different inductance values and a mixture of inductor-to-inductor spacings resulting in a decreasing effective shunt inductance with increasing distance from the antenna feed terminals.

In configurations such as the illustrative configuration of FIG. 20 the scatter-type portion may handle communications in one frequency band and the horn-type portion may handle communications in second communications band. The first band may have a higher or lower center frequency than the second band. The antenna may also be used to handle communications in a single frequency band with increased efficiency relative to a shorter antenna (e.g., an antenna having only a horn type antenna structure or only a scatter-type antenna structure).

Figure 21:
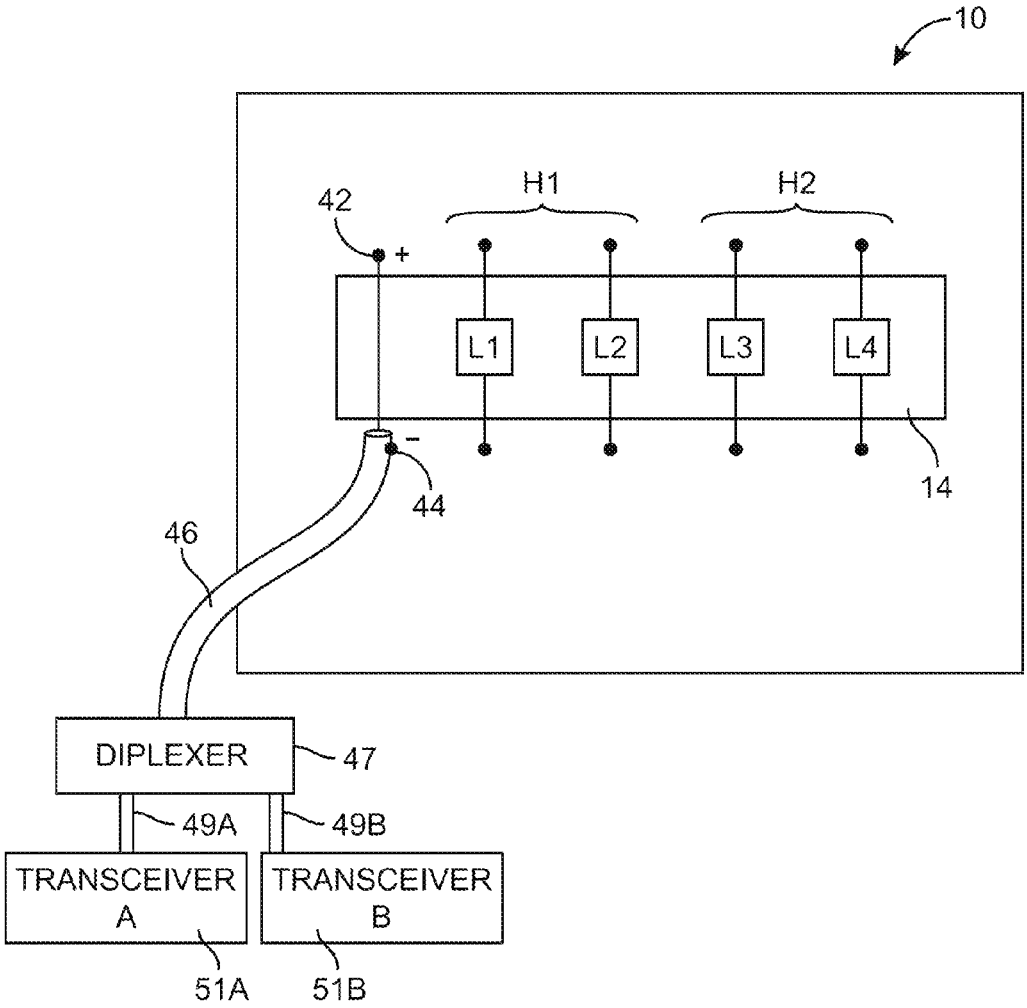
FIG. 21 is a top view of an illustrative antenna having a first portion in which shunt inductors of potentially different values are placed along the antenna's length at potentially unequally spaced locations and having a second portion in which shunt inductors of potentially different values are placed along the antenna's length at potentially unequally spaced locations.

In the illustrative configuration of FIG. 21, antenna 10 has a first portion H1 and a second portion H2. Portions H1 and H2 may be horn-type antenna structures with different efficiencies in different communications bands. In horn antenna structure H1, inductance L2 may be less than inductance L1. In horn antenna structure H2, inductance L4 may be less than inductance L3. Inductance L3 may be less than inductance L2 (as an example).

In multiband antennas 10 such as antenna 10 of FIG. 21 and the other antennas 10 described herein, a diplexer such as diplexer 47 may be used to couple two separate transceivers to the antenna. For example, a first transmission line such as transmission line 49A of FIG. 21 may be used to couple transceiver 51A to diplexer 47 and a second transmission line such as transmission line 49B of FIG. 21 may be used to couple transceiver 51B to diplexer 47. Transmission line 46 may be coupled to gap 14 using antenna terminals 42 and 44. Transmission line 49A, associated transceiver 51A, and antenna structure H1 may be used to handle communications in a first communications band. Transmission line 49B, associated transceiver 51B, and antenna structure H2 may be used to handle communications in a second communications band. The center frequency of the first communications band may be less than or more than the center frequency of the second communications band. Structures of the type shown in FIG. 21 may also be used to handle communications in a single band.

Figure 22:
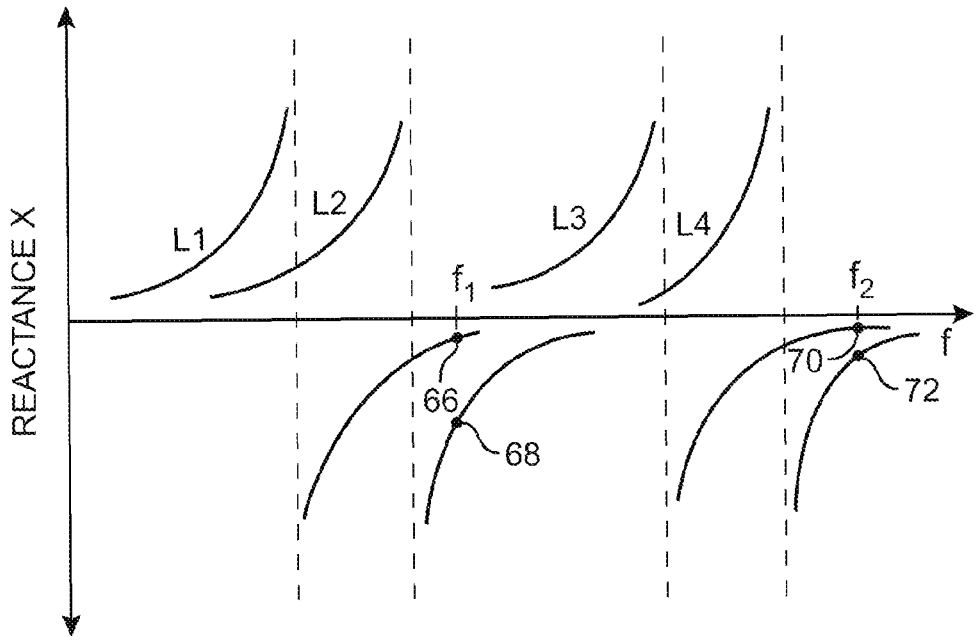
FIG. 22 is a graph in which the reactance of an antenna of the type shown in FIG. 21 is plotted as a function of frequency in accordance with an embodiment of the present invention.

A graph showing the predicted reactance X of antenna structures H1 and H2 as a function of frequency is shown in FIG. 22. As shown in FIG. 22, at frequency f1 (e.g., the center of the first communications band), the magnitude of the reactance X may increase from the value at point 66 to the value at point 68. These values may correspond to the characteristics of horn-type antenna H1. At frequency f2 (e.g., the center of the second communications band), the magnitude of the reactance X may increase from the value at point 70 to the value at point 72. These values may correspond to the characteristics of horn-type antenna H2. Although two cascaded horn antenna structures H1 and H2 are shown in the example of FIG. 22, in general any suitable number of horn antenna structures may be cascaded if desired.

Figure 23:
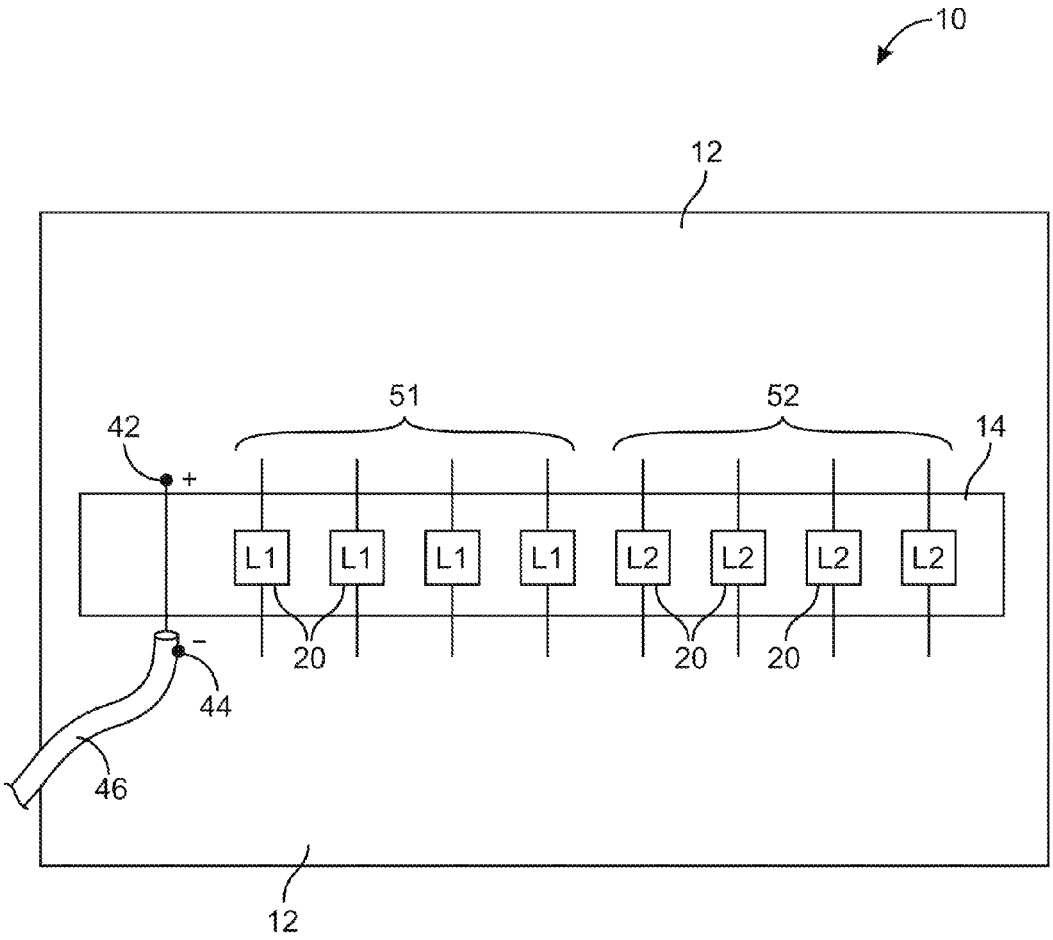
FIG. 23 is a top view of an illustrative antenna having a first portion in which shunt inductors of potentially equal values are placed along the antenna's length at potentially equally spaced locations and having a second portion in which shunt inductors of potentially equal values are placed along the antenna's length at potentially equally spaced locations so that the antenna may handle multiple communications bands in accordance with an embodiment of the present invention.

Antenna 10 may also be formed by cascading two or more scatter-type antenna structures. An antenna 10 of this type is shown in FIG. 23. In the example of FIG. 23, antenna 10 has a first portion and a second portion. First portion S1 and second portion S2 each have four shunt inductors 20. The inductors 20 in first portion S1 may have an inductance value of L1. The inductance values of inductors 20 in second portion S2 may have an inductance value of L2. Inductance L1 may be greater than or less than inductance L2. For example, inductance L1 may be greater than inductance L2.

Scatter-type antenna structure S1 may be used to handle communications in a first communications band (e.g., 2.4 GHz), whereas scatter-type antenna structure S2 may be used to handle communications in a second communications band (e.g., 5.4 GHz). Each band may be fed using a corresponding transceiver through transmission line 46. For example, a first transceiver may be used for a first communications band and a second transceiver may be used for a second communications band.

Figure 24:
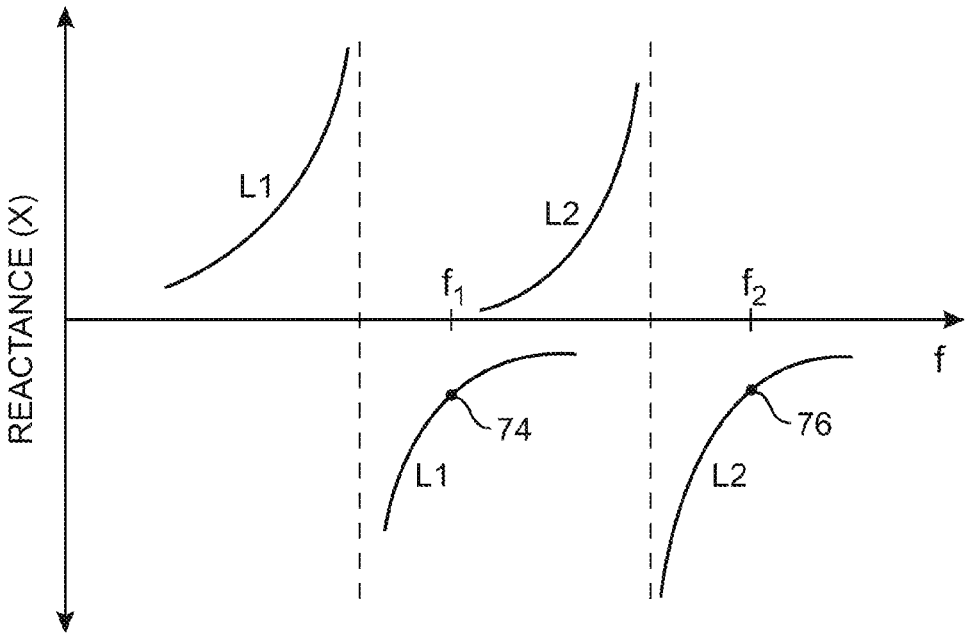
FIG. 24 is a graph in which the reactance of an antenna of the type shown in FIG. 21 is plotted as a function of frequency in accordance with an embodiment of the present invention.

A graph of the reactance X of antenna 10 as a function of frequency is shown in FIG. 24. As shown in FIG. 24, scatter-type antenna structure S1 (with shunt inductors of value L1) may be characterized by the reactance of point 74 at frequency f1 (e.g., at 2.4 GHz), whereas scatter-type antenna structure S2 (with shunt inductors of value L2) may be characterized by the reactance of point 76 at frequency f2 (e.g., at 5.4 GHz). These reactance values may allow scatter-type antenna structure S1 to efficiently handle communications in the first communications band (e.g., the band centered at 2.4 GHz) while scatter-type antenna structure S2 may efficiently handle communications in the second communications band (e.g, the band centered at 5.4 GHz).

As these examples demonstrate, hybrid antennas may be formed from combinations of one or more scatter-type and one or more horn type antenna structures. Non-hybrid antennas may be formed from one or more scatter-type antenna structures or may be formed from one or more horn-type antenna structures. The use of multiple such structures in a single antenna may allow the antenna to cover multiple communications bands of interest or may support improved antenna efficiency in a given communications band.

The foregoing is merely illustrative of the principles of this invention and various modifications can be made by those skilled in the art without departing from the scope and spirit of the invention.

What is claimed is:

1. An antenna comprising:

first and second coplanar conductive regions that are spaced apart to form a gap, wherein the first and second coplanar conductive regions are formed from a conductive housing of electronic device computing equipment;

first and second antenna terminals that are connected to the conductive regions and that form an antenna feed for the antenna; and a plurality of shunt inductors each of which bridges the gap and each of which forms an active part of the antenna, wherein the conductive housing of the electronic device computing equipment that the first and second coplanar conductive regions are formed from comprises conductive housing for a device selected from the group consisting of: a laptop computer, a cellular telephone, a desktop computer, a computer that is integrated into a computer monitor, a handheld computer, a wrist-watch device, and a media player.

2. The antenna defined in claim 1 wherein the conductive housing comprises a metal housing and wherein the gap is formed in the metal housing and is invisible to a naked eye.

3. The antenna defined in claim 1 wherein the gap has a longitudinal axis and wherein the inductors are separated by equal spacings along the longitudinal axis.

4. The antenna defined in claim 1 wherein the gap has a longitudinal axis and wherein the inductors are separated by unequal spacings along the longitudinal axis.

5. The antenna defined in claim 1 wherein the inductors each have the same inductance.

6. The antenna defined in claim 1 wherein the inductors are arranged at multiple distances from the antenna feed and wherein the inductors have decreasing inductances as distance from the feed increases.

7. The antenna defined in claim 1 wherein the inductances are unequal.

8. The antenna defined in claim 1 wherein the gap has a pair of ends and wherein both ends of the gap are open.

9. The antenna defined in claim 1 wherein the gap has a pair of ends and wherein both ends of the gap are closed.

10. The antenna defined in claim 1 wherein the gap has ends and wherein one of the ends of the gap is open and one of the ends of the gap is closed.

11. The antenna defined in claim 1 wherein the plurality of shunt inductors are formed from surface-mount components.

12. The antenna defined in claim 1 wherein the gap has a tapered width.

13. The antenna defined in claim 1 wherein the inductors have inductances in the range of 1-1000 nH.

14. The antenna defined in claim 1 wherein the conductive housing of the electronic device computing equipment completely surrounds and encloses the gap.

15. An antenna comprising:

first and second coplanar conductive regions that are spaced apart to form a gap, wherein the first and second coplanar conductive regions are formed from a conductive housing of electronic device computing equipment;

first and second antenna terminals that are connected to the conductive regions and that form an antenna feed for the antenna; and a plurality of shunt inductors each of which bridges the gap and each of which forms an active part of the antenna, wherein a first set of the inductors forms a scatter-type antenna having inductors of a first inductance value and wherein a second set of the inductors forms a scatter-type antenna having inductors of a second inductance value that is different from the first inductance value.

16. An antenna comprising:

first and second coplanar conductive regions that are spaced apart to form a gap, wherein the first and second coplanar conductive regions are formed from a conductive housing of electronic device computing equipment;

first and second antenna terminals that are connected to the conductive regions and that form an antenna feed for the antenna; and a plurality of shunt inductors each of which bridges the gap and each of which forms an active part of the antenna, wherein a first set of the inductors forms a scatter-type antenna structure and wherein a second set of the inductors forms a horn-type antenna structure.

17. An antenna comprising:

first and second coplanar conductive regions in conductive electronic device computing equipment housing that are spaced apart to form a gap;

first and second antenna terminals that are respectively connected to the first and second coplanar conductive regions and that form an antenna feed for the antenna; and a plurality of shunt inductors each of which bridges the gap, wherein the electronic device computing equipment comprises computing equipment selected from the group consisting of: a laptop computer, a cellular telephone, a desktop computer, a computer that is integrated into a computer monitor, a handheld computer, a wrist-watch device, and a media player.

18. The antenna defined in claim 17 wherein the shunt inductors comprise surface-mount components.

19. The antenna defined in claim 17 wherein at least some of the inductors have different inductances.

20. The antenna defined in claim 19 wherein the inductors have inductances that are each in a range of 1 nH to 1000 nH.

21. The antenna defined in claim 17 wherein the conductive electronic device computing equipment housing comprises metal that forms a surface for an electronic device computing equipment and wherein the gap has a width in the surface that renders the gap unnoticeable under normal observation by a user of the electronic device computing equipment.

* * * * *